US012722873B2

(12) United States Patent
Ong

(10) Patent No.: US 12,722,873 B2
(45) Date of Patent: Sep. 1, 2026

(54) MULTI-FUNCTION AEROSOL VALVE ASSEMBLY

(71) Applicant: Samurai 2K Aerosol Sdn. Bhd., Skudai (MY)

(72) Inventor: Yoke En Ong, Skudai (MY)

(73) Assignee: Samurai 2K Aerosol Sdn. Bhd., Skudai (MY)

( * ) Notice: Subject to any disclaimer, the term of this patent is extended or adjusted under 35 U.S.C. 154(b) by 160 days.

(21) Appl. No.: 18/697,579

(22) PCT Filed: Oct. 25, 2021

(86) PCT No.: PCT/MY2021/050093
§ 371 (c)(1),
(2) Date: Apr. 1, 2024

(87) PCT Pub. No.: WO2023/055228
PCT Pub. Date: Apr. 6, 2023

(65) Prior Publication Data

US 2024/0409301 A1 Dec. 12, 2024

(30) Foreign Application Priority Data

Sep. 30, 2021 (MY) ..... PI 2021005835

(51) Int. Cl.
*B65D 83/48* (2006.01)
*B65D 83/42* (2006.01)
*B65D 83/666* (2025.01)

(52) U.S. Cl.
CPC ..... *B65D 83/48* (2013.01); *B65D 83/425* (2013.01); *B65D 83/666* (2013.01)

(58) Field of Classification Search
CPC .... B65D 83/48; B65D 83/425; B65D 83/666; B65D 83/58; B65D 83/687; B65D 83/40;
(Continued)

(56) References Cited

U.S. PATENT DOCUMENTS 3,074,601 A 1/1963 Kuffer
3,080,094 A 3/1963 Modderno
(Continued)

FOREIGN PATENT DOCUMENTS

| | | |
|---|---|---|
| CH | 382075 | 9/1964 |
| JP | 2003292072 | 10/2003 |
| WO | 2020242287 | 12/2020 |

OTHER PUBLICATIONS

English Abstract of JP2003292072.
(Continued)

*Primary Examiner* — Vishal Pancholi
(74) *Attorney, Agent, or Firm* — Preston Smirman; SMIRMAN IP LAW, PLLC

(57) ABSTRACT

An aerosol container including a body, a divider, and an aerosol valve assembly enclosing an opening of an inner chamber and including any one or a combination of a content-filling mechanism, gas-discharging mechanism, rupturing mechanism and content-dispensing mechanism. Upon activation of the aerosol valve assembly, the content-filling mechanism enables the formation of a content-filling passage to allow external content to be added into the body, the gas-discharging mechanism enables the formation of a gas-discharging passage to allow unwanted or excess gas to be released out of the container, the rupturing mechanism acts on a puncture member to rupture the divider so as to allow coalescing of content within an inner chamber and outer chamber to form a coalesced content, and the content-dispensing mechanism enables the formation of a content-dispensing passage to dispense the content out of the body.

14 Claims, 9 Drawing Sheets

(58) Field of Classification Search
CPC .... B65D 81/3222; B65D 51/28; B05B 15/25; B05B 7/0483
See application file for complete search history.

(56) References Cited

U.S. PATENT DOCUMENTS

| | | | | |
|---|---|---|---|---|
| 3,455,489 | A | 7/1969 | Meshberg | |
| 3,603,483 | A * | 9/1971 | Morane | B65D 83/687 222/137 |
| 3,613,960 | A | 10/1971 | Beard | |
| 3,635,261 | A * | 1/1972 | Morane | B65B 29/10 141/3 |
| 4,613,061 | A | 9/1986 | Meuresch et al. | |
| 6,196,421 | B1 * | 3/2001 | Williams | B65D 83/68 222/402.1 |
| 2020/0180850 | A1 * | 6/2020 | Saw | B65D 83/687 |

OTHER PUBLICATIONS

English Abstract of CH382075.
International Search Report Dated Feb. 8, 2022.
Written Opinion of the International Searching Authority Dated Feb. 8, 2022.
International Preliminary Report on Patentability Dated Nov. 22, 2023.

* cited by examiner

MULTI-FUNCTION AEROSOL VALVE ASSEMBLY

CROSS-REFERENCE TO RELATED APPLICATION

The instant application is a national phase of PCT International Application No. PCT/MY2021/050093 filed Oct. 25, 2021, and claims priority to Malaysian Patent Application Serial No. PI 2021005835 filed Sep. 30, 2021, the entire specifications of both of which are expressly incorporated herein by reference.

FIELD OF INVENTION

The invention relates to an aerosol valve assembly for an aerosol container. More particularly, the invention relates to an aerosol valve assembly that can support filling of content, degassing of air from the aerosol container, coalescing of content and dispensing of content.

BACKGROUND OF THE INVENTION

An aerosol container typically comprises a metal container body and an aerosol valve assembly, wherein the body stores content such as a payload and propellant, while the aerosol valve assembly provides a "gate" for the said content to enter or exit the aerosol container. The payload may be, but shall not be limited to, one-component paint or multi-component paint. In the case of multi-component paint, all components are preferably coalesced, or mixed, prior to being dispensed. The propellant may be, but shall not be limited to, pressurized air or hydrocarbons. The propellant is stored in the aerosol can at high pressure, so that exert a pressure force for the payload to be dispensed through a nozzle when the aerosol valve assembly is actuated by an actuator.

The aerosol valve assembly is mounted onto the body through the support of a mounting cup. It further comprises a housing, a resilient means such as a spring, and a gasket. A stem is used to form a path in the aerosol valve assembly. When an actuator of the aerosol container is pressed, the resilient means is compressed with the stem is displaced downwardly away from the gasket, and the content shall be dispensed due to pressure differences. When the actuator is un-pressed, the resilient means is de-compressed with the stem is displaced upwardly back to the upward position, preventing the content from being dispensed.

The aerosol valve assembly may come as a male-type or female-type. In the male-type aerosol valve assembly, the stem is integrated therein, protruding outwardly from the housing and the mounting cup. Whereas in a female-type aerosol valve assembly, the stem is integrated with the actuator, and it to be inserted into the housing of the aerosol valve assembly.

The stem of male-type aerosol valves tends to bend or break during the aerosol container manufacturing process, especially during the stage of crimping and filling of content through the aerosol valve assembly. This will render the aerosol container unusable. Therefore, it is preferable that a female-type aerosol valve is used as it shall reduce the failure rate during the manufacturing process.

There are a few patented technologies over the prior art that relate to an aerosol valve assembly. Among them is U.S. Pat. No. 3,074,601, which discloses a kind of female type aerosol valve assembly that includes a removable dispensing tip on its actuator that may be interchanged with another similar tip to discharge the content of the container either in the form of a stream, a spray or as foam, depending upon the nature of the product in the container.

Another patented technology is U.S. Pat. No. 3,613,960, which discloses a kind of aerosol container having a female type valve assembly that allows for refilling of the content to take place. It is capable of being filled with payload and propellant up to a predetermined level, and further comprises a cylindrical shell having a first annular disc connected to one end of the shell and a second annular disc connected to the other end of the shell. A first valve cap having a two-way dual-purpose valve positioned therein for receiving and dispensing liquids is connected to the first annular disc and a second valve cap having a second dual-purpose valve located therein for dispensing excess gases is connected to the second annular disc. Nozzle heads may be added to the dual-purpose valves so that the valves can be used to spray liquids.

Even so, the aforementioned patented technologies that relate to the female type aerosol valve assemblies lack multi-function capabilities. The valve assembly in U.S. Pat. No. 3,074,601 can only dispense content, while U.S. Pat. No. 3,613,960 requires the use of two separate valve assemblies at two ends of the aerosol container so that the refilling of content, dispensing of content and degassing of the container can be done. Moreover, both prior arts are not configured to be integrated into an aerosol container containing multi-component payload.

No solutions were disclosed by the aforementioned patents that can provide a kind of universal aerosol valve assembly that can support filling of content, degassing of air from the aerosol container, coalescing of content and dispensing of content. Accordingly, it would be desirable to have an aerosol valve assembly of the female type that can support the aforementioned functionalities, especially for an aerosol container having multi-component payload.

SUMMARY OF INVENTION

The main objective of the invention is to provide an aerosol valve assembly, preferably of the female type, that can support filling of content, degassing of air from the aerosol container, coalescing of content and dispensing of content, especially for an aerosol container containing multi-component payload. To achieve this objective the aerosol valve assembly is configured so that it can receive a detachable component that shall allow the aerosol valve assembly to activate a content-filling mechanism for filling content, a gas-discharging mechanism for degassing the container, a rupturing mechanism for coalescing the content, a content-dispensing mechanism for dispensing content, or any combination thereof.

Advantageously, the aerosol valve assembly of the present invention can avoid damage to the stem during further aerosol container manufacturing process lines while also being compatible with aerosol containers having multi-component payload. The most significant improvement of the invention is that the process of filling, dispensing, degassing and component coalescing can be done using the same aerosol valve assembly.

The invention intends to provide an aerosol container comprising a body including an outer chamber and an inner chamber positioned within the outer chamber, the inner chamber having a divider that separates it from the outer chamber, and an opening, a puncture member for rupturing the divider, and an aerosol valve assembly enclosing the opening of the inner chamber and including any one or a combination of a content-filling mechanism, gas-discharging mechanism, rupturing mechanism and content-dispensing mechanism. Upon activation of the aerosol valve assembly, the content-filling mechanism enables the formation of a content-filling passage to allow external content to be added into the body, the gas-discharging mechanism enables the formation of a gas-discharging passage to allow unwanted or excess gas to be released out of the body, the rupturing mechanism acts on the puncture member to rupture the divider so as to allow coalescing of content within the inner chamber and outer chamber to form a coalesced content, and the content-dispensing mechanism enables the formation of a content-dispensing passage to dispense the content out of the body.

Preferably, the aerosol valve assembly of the aerosol container comprises a mounting cup mounted to the opening of the inner chamber and having an aperture, a valve housing positioned within the inner chamber and adjacent to the aperture of the mounting cup, a valve core accommodated within the valve housing, having a cap portion, and a valve shaft connected to the cap portion, and an inlet formed between the cap portion and the valve shaft where the valve shaft is movable within the valve core to expose or close the inlet.

Preferably, the aerosol container further comprises a detachable component inserted into the aperture of the mounting cup, being either a content-filling device having a content-filling activation stem, a gas-discharging device having a discharge activation stem, a content-filling and gas-discharging device having a content-filling and a discharge activation stem, a rupturing device having a rupture activation stem, a content-dispensing device having a content-dispensing activation stem, or a combination thereof.

Preferably, the content-filling mechanism includes the valve shaft, and valve core with the cap portion being configured to receive the content-filling stem therethrough for supplying the external content into the valve core while pushing the valve shaft to expose the inlet of the valve core for directing the external content through the valve core and into the inner chamber.

Preferably, the content-filling passage includes the content-filling device, the valve core, a channel formed by a dip tube within the puncture member that is connected to the valve core, and the inner chamber.

Preferably, the gas-discharging mechanism includes the valve shaft, and valve core with the cap portion configured to receive the discharge activation stem for moving the valve core away from the aperture of the mounting cup to create a gap therebetween to allow exit of the unwanted or excess gas from the body of the aerosol container through the gas-discharging device.

Preferably, the gas-discharging passage includes, either or both, a combination of the inner chamber, valve housing and discharge conduit within the gas-discharging device, and a combination of the inner chamber, a passageway formed between the puncture member and valve housing, the valve core, and the discharge conduit of the gas-discharging device.

Preferably, the content-filling mechanism and gas-discharging mechanism are configured to operate simultaneously upon activation of the aerosol valve assembly by the content-filling and discharge activation stem which allows the external content to be supplied from the stem through the cap portion while moving the valve shaft to expose the inlet of the valve core for directing the external content into the valve core, and moving the valve core away from the aperture of the mounting cup to create a gap therebetween to allow exit of the unwanted or excess gas from the body of the aerosol container through the content-filling and gas-discharging device.

Preferably, the rupturing mechanism includes the valve core, and valve housing which sits within a recess formed at one end of the puncture member that is slidable along the valve housing such that upon activation of the valve assembly by the rupture activation stem, the valve core is pushed to displace the puncture member towards the direction of the divider to rupture it.

Preferably, the aerosol container further comprises a dip tube forming a channel inside the puncture member that or moves along with the puncture member to reach the outer chamber upon rupturing the divider.

Preferably, the valve core is configured to substantially or fully return to its original position within the valve housing upon removal of the rupture activation stem, that disconnects the valve core and the channel of the puncture member, forming a cavity within the puncture member by having the recess covered by the valve housing.

Preferably, the content-dispensing mechanism includes the valve housing, and valve core with the cap portion being configured to receive the content-dispensing activation stem that displaces the valve core away from the aperture of the mounting cup, leaving a gap therebetween to allow content to be dispensed out of the aerosol container through the content-dispensing device. Preferably as well, the puncture member is formed with a recess at one end that is covered by the valve housing to create a cavity within the puncture member, and has a dip tube forming a channel inside the puncture member.

Preferably, the content-dispensing passage includes the body of the aerosol container, the channel within the puncture member, the cavity of the puncture member, the valve housing, conduits between the cap portion of the valve core and the content-dispensing activation stem, and the content-dispensing device. Preferably as well, the content-dispensing activation stem is formed with a dimension to fix the position of the valve core during the formation of the gap.

The present invention further intends to provide an aerosol valve assembly for a body of an aerosol container, that includes any one or a combination of a content-filling mechanism, gas-discharging mechanism, rupturing mechanism and content-dispensing mechanism. Upon activation of the aerosol valve assembly, the content-filling mechanism enables formation of a content-filling passage to allow external content to be added into the body of the aerosol container, the gas-discharging mechanism enables formation of a gas-discharging passage to allow unwanted or excess gas to be released out of the body of the aerosol container, the rupturing mechanism allows coalescing of content within the body of the aerosol container to form a coalesced content, and the content-dispensing mechanism enables formation of a content-dispensing passage to dispense the content out of the body of the aerosol container.

Preferably, the aerosol valve assembly comprises a mounting cup mounted to an opening of the body of the aerosol container and having an aperture, a valve housing positioned within the body of the aerosol container and adjacent to the aperture of the mounting cup, a valve core accommodated within the valve housing, having a cap portion, and a valve shaft connected to the cap portion, and an inlet formed between the cap portion and the valve shaft where the valve shaft is movable within the valve core to expose or close the inlet.

One skilled in the art will readily appreciate that the invention is well adapted to carry out the objects and obtain the ends and advantages mentioned, as well as those inherent therein. The embodiments described herein are not intended as limitations on the scope of the invention.

BRIEF DESCRIPTION OF THE DRAWINGS

To facilitate an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

Figure 1:
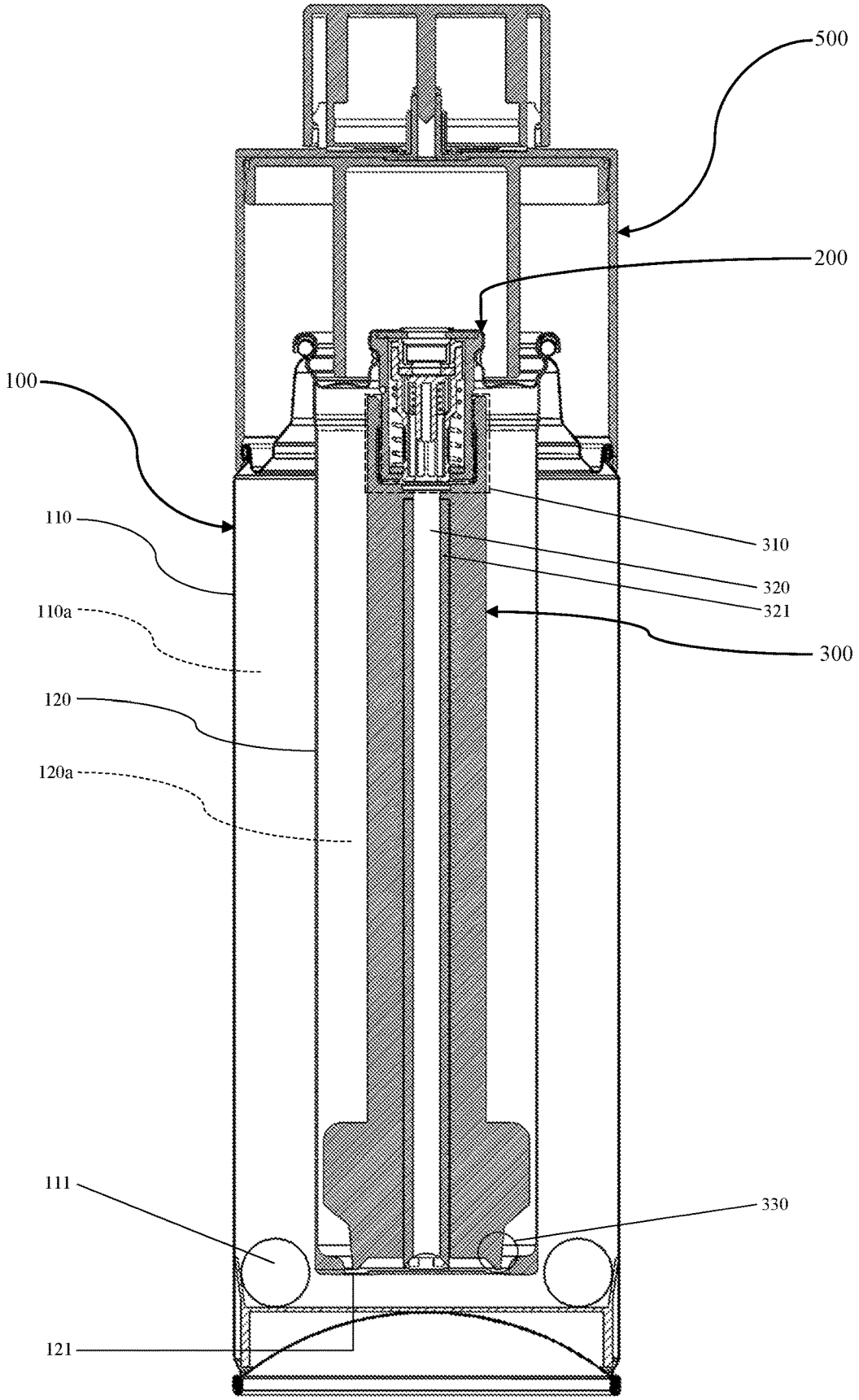
FIG. 1 is a diagram illustrating the cross-sectional view of the aerosol container and the aerosol valve assembly in an inert state being sealed by a seal lock device placed.

The present invention relates to an aerosol valve assembly for an aerosol container. More particularly, the invention relates to an aerosol valve assembly that can support filling of content, degassing of air from the aerosol container, coalescing of content and dispensing of content, especially for an aerosol container containing multi-component payload. The invention may also be presented in a number of different embodiments with common elements.

According to the concept of the invention, the aerosol container is preferably configured to accommodate multi-component payload, with a body with an inner chamber and an outer chamber. The aerosol container further has an aerosol valve assembly that encloses the opening of the inner chamber and is configured to receive a detachable component that shall allow the aerosol valve assembly to activate a content-filling mechanism for filling content, a gas-discharging mechanism for degassing the aerosol container, a rupturing mechanism for coalescing the content, a content-dispensing mechanism for dispensing content, or any combination thereof.

From hereon, in the context of the present invention, it shall be understood that the term "content" may refer to aqueous or gaseous fluids, which may include the payload and the propellant. The payload may be multi-component having one or more paints, or any kind of pigmented liquids or fluids, mastic compositions, polyurethane enamels, or any kind of chemical compounds related to colouring applications. It shall be established that aerosol valve assembly shall be used in an aerosol container having two-component payload, or a payload with two components. The two components preferably being a resin component and a hardener component. Preferably, the resin component is stored in an outer chamber of the aerosol container and the hardener component is stored in an inner chamber of the aerosol container. As for the propellant, it may be, but shall not be limited to pressurized air, hydrocarbons, organic compounds or the likes.

From hereon, it will be understood that, although the terms first, second, etc. may be used herein to describe various elements, components, regions, layers or sections, these elements, components, regions, layers or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

From hereon as well, spatially relative terms, such as "upper", "lower", and the like, may be used herein for ease of description to describe one element or feature's relationship to another element or feature as illustrated in the figures. It will be understood that the spatially relative terms are intended to encompass different orientations of the assembly in use or operation in addition to the orientation depicted in the figures. For example, if the assembly in the figures is turned over, elements described as "upper" other elements or features would then be oriented "below" the other elements or features. Thus, the exemplary term "upper" can encompass both an orientation of above and below. The device may be otherwise oriented and the spatially relative descriptors used herein interpreted accordingly.

The invention will now be described in greater detail, by way of example, with reference to the drawings. It should be noted that these figures illustrate longitudinal cross-sections of the aerosol container, which are symmetrical. As such, components of the aerosol container and processes that occur within that are labelled shall also be mirrored and applies to their unlabelled counterparts.

Figure 2:
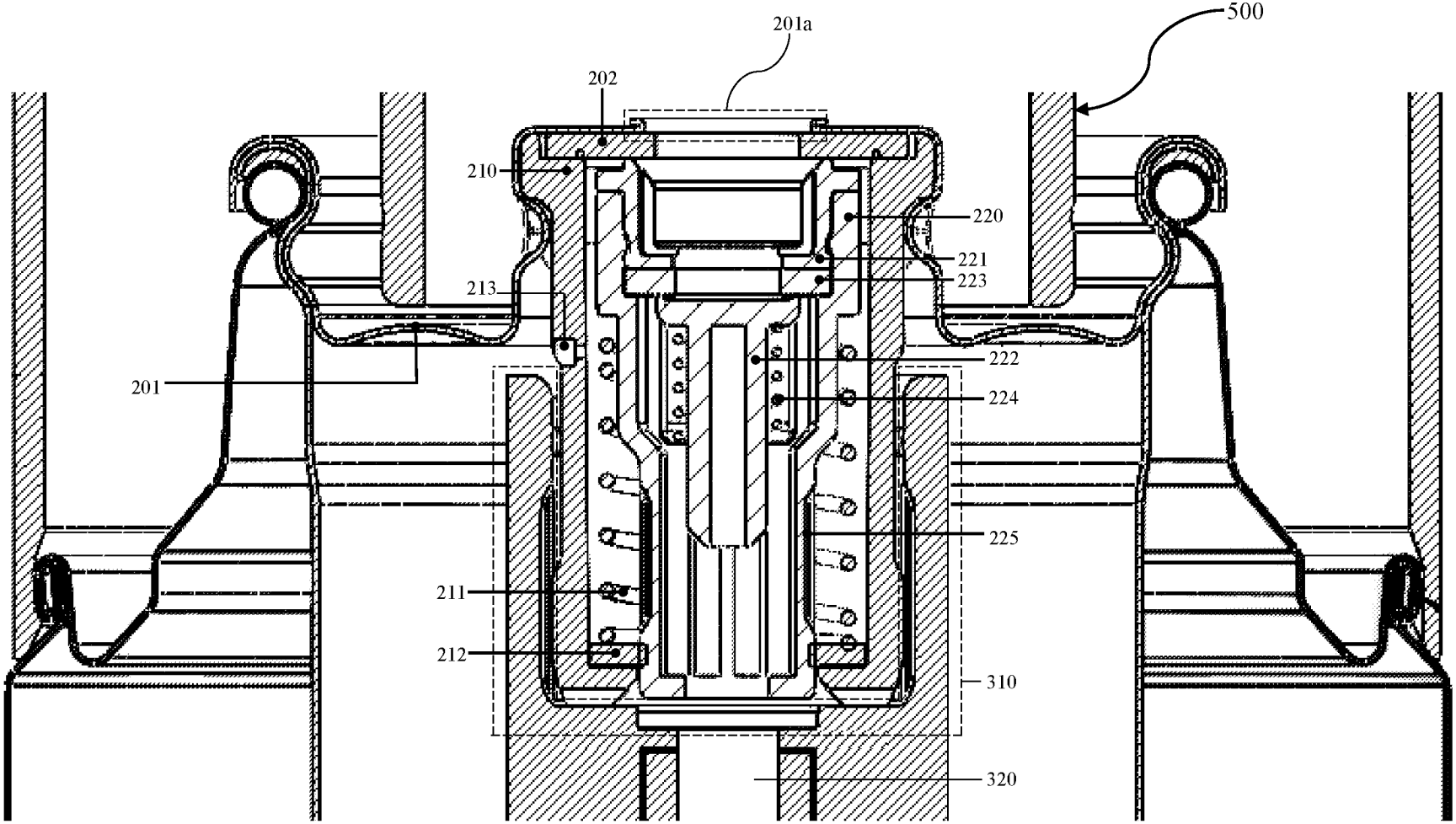
FIG. 2 is a zoomed-in diagram of FIG. 1 focusing on the aerosol valve assembly on the aerosol container.

FIG. 1 illustrates a cross-sectional view of the aerosol container, comprising the body 100 and the aerosol valve assembly 200. Whereas FIG. 2 is an illustration that specifically focuses on the aerosol valve assembly 200 and its related components.

From FIG. 1 as well, the body 100 is preferably cylindrical, having a hollow outer compartment 110, and the inner walls of the outer compartment 110 make up an outer chamber 110*a*. Preferably, the outer compartment 110 is of metallic material that is strong enough to withstand the pressure exerted by the propellant. The upper portion of outer compartment 110 is tapered and further comprises an opening that allows the accommodation of a hollow inner compartment 120, with the aperture of the inner compartment 120 supported by the rims of the opening. Preferably, before the inner compartment 120 is accommodated within the outer compartment 110, it is pre-filled with content, particularly a payload being a resin component, and the propellant. The inner compartment 120 is substantially smaller in diameter and volume compared to the outer compartment 110, and the inner walls of the inner compartment 120 make up the inner chamber 120*a*. The bottom end portion of the inner compartment 120 is a divider 121 that is preferably made of thin or soft material that is easily punctured or perforated. This may be, but shall not be limited to rubber, polyethene terephthalate (PETE) or the likes.

From FIG. 1 as well, it can be seen that the aerosol valve assembly 200 further comprises a mounting cup 201 and a valve housing 210. The mounting cup 201 seals the opening of the inner compartment 120 through a crimping process, thus creating a leak-proof space in the inner chamber 120*a* and outer chamber 110*a*. Directly below the aerosol valve assembly 200 is a puncture member 300. When coalescing, by means of mixing, of the content of the inner chamber 120*a* and outer chamber 110*a* is desired, the puncture member 300 shall rupture the divider 121 of the inner compartment 120 so that the content of the inner chamber 120*a* shall flow into the outer chamber 110*a* and coalesce. One or more agitator balls 111 may be included within the outer compartment 110 to aid in this process.

From FIG. 1, it can be seen that aerosol valve assembly 200 is seated on a recess 310 formed at an upper portion of the puncture member 300. Preferably, the aerosol valve assembly 200 is slidable along the walls of the recess 310, with its conduit connected to a channel 320 of the puncture member 300 that may be formed by a dip tube 321. Alternatively, the dip tube 321 may not be present, and the channel 320 is integrated to be part of the puncture member 300. The lower-end portion of the puncture member 300 further contains one or more projections 330 that would allow the puncture member 300 to rupture the divider 121 of the inner compartment 120 when coalescing of content, which are payload components, is required.

From FIG. 1 and FIG. 2, with the aerosol valve assembly 200 in full view, it can be seen that the mounting cup 201 has another aperture 201*a*. Adjacent to said aperture 201*a* and within the inner compartment 120 there is a valve housing 210 that is conjoined to the aperture 201*a* with a first gasket seal 202 in-between. The valve housing 210 has a hollow cylindrical body that houses the principle components of the valve of the aerosol container, and within it, there is a tubular valve core 220 that is sleeved within a first resilient member 211, which may be a spring or any form of elastic device. Such a configuration shall allow a vertical displacement of the valve core 220 within the confines of the valve housing 210. The valve housing 210 is formed with an annular base protruding inwardly at its lower-end portion, where the first resilient member 211 rests thereon with a third gasket seal 212 in-between. Furthermore, disposed around middle portion of the valve housing 210 and slightly above the recess 310 is a side hole 213.

From FIG. 2, The valve core 220 itself has a hollow cylindrical body, but having different diameters at each of its upper-end and lower-end portions to assume a shape similar to a reducing socket. The valve core 220 further comprises cap portion 221 and a valve shaft 222 disposed within, with a second gasket seal 223 in-between the cap portion 221 and the valve shaft 222. The valve shaft 222 is tubular and is sleeved within a second resilient member 224 within the valve core 220. The second resilient member 224 is similar to the first resilient member 211, being a spring as well. Such a configuration allows a vertical displacement of the valve shaft 222 within the confines of the valve core 220. As the valve shaft 222 is displaced vertically downwards, an inlet is formed between the valve shaft 222 and the second gasket seal 223 that allows an inflow of external content, preferably a payload being a hardener component, into the body 100. Furthermore, the cap portion 221 is configured to be able to influence the displacement of the entire valve core 220 or just the valve shaft 222 in the valve core 220. This is because the cap portion 221 is formed with an annular base protruding inwardly from its bottom end portion. Finally, near the bottom end portion of the valve core 220 with a smaller diameter, there are areas on the external walls of the valve core 220 that are formed with indented portions 225.

From FIG. 1 and FIG. 2, it is shown that the aerosol container is in an inert state suitable for storage after being manufactured. To configure the aerosol container to be in such a state, it is required that a fastening device 500 is rested on the top of the aerosol container, in particular, on top of the mounting cup 201 of the aerosol valve assembly 200. The fastening device 500 does not have any stem of sorts that would cause a positional change in the entire valve core 220 or just the valve shaft 222 in the valve core 220. As the resilient members 211, 224 of the aerosol valve assembly 200 actively pushes the components of the aerosol valve assembly 200 against the gasket seals 202, 223, there is no leakage of the content from the aerosol container. The fastening device 500 also protects the aperture 201*a* of the aerosol valve assembly 200 from any foreign objects, especially rod-like objects, which may cause accidental displacement of the components of the aerosol valve assembly 200.

Figure 3:
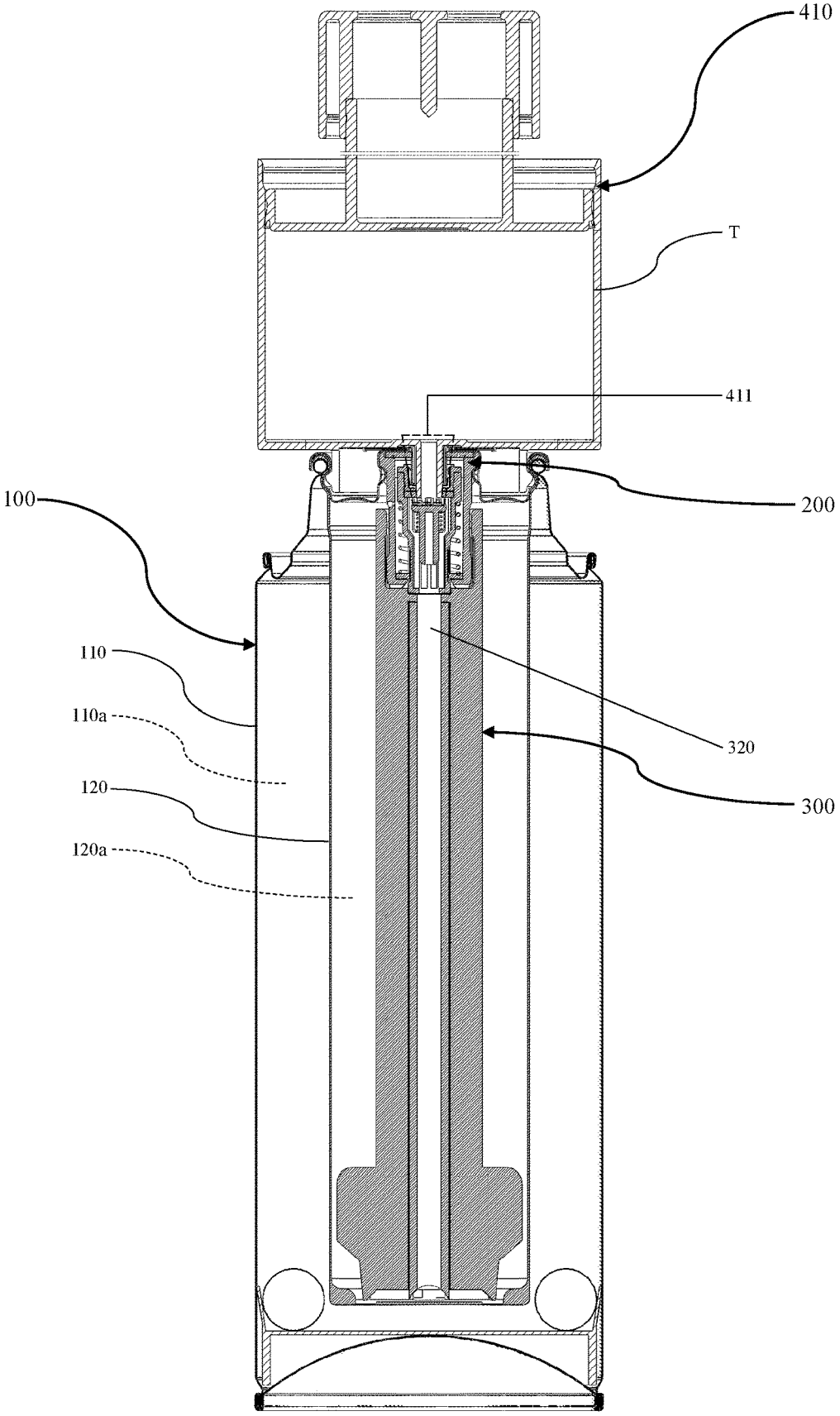
FIG. 3 is a diagram illustrating the cross-sectional view of the aerosol container and the aerosol valve assembly in an activated state that allows operation of the content-filling mechanism and gas-discharging mechanism.
Figure 4:
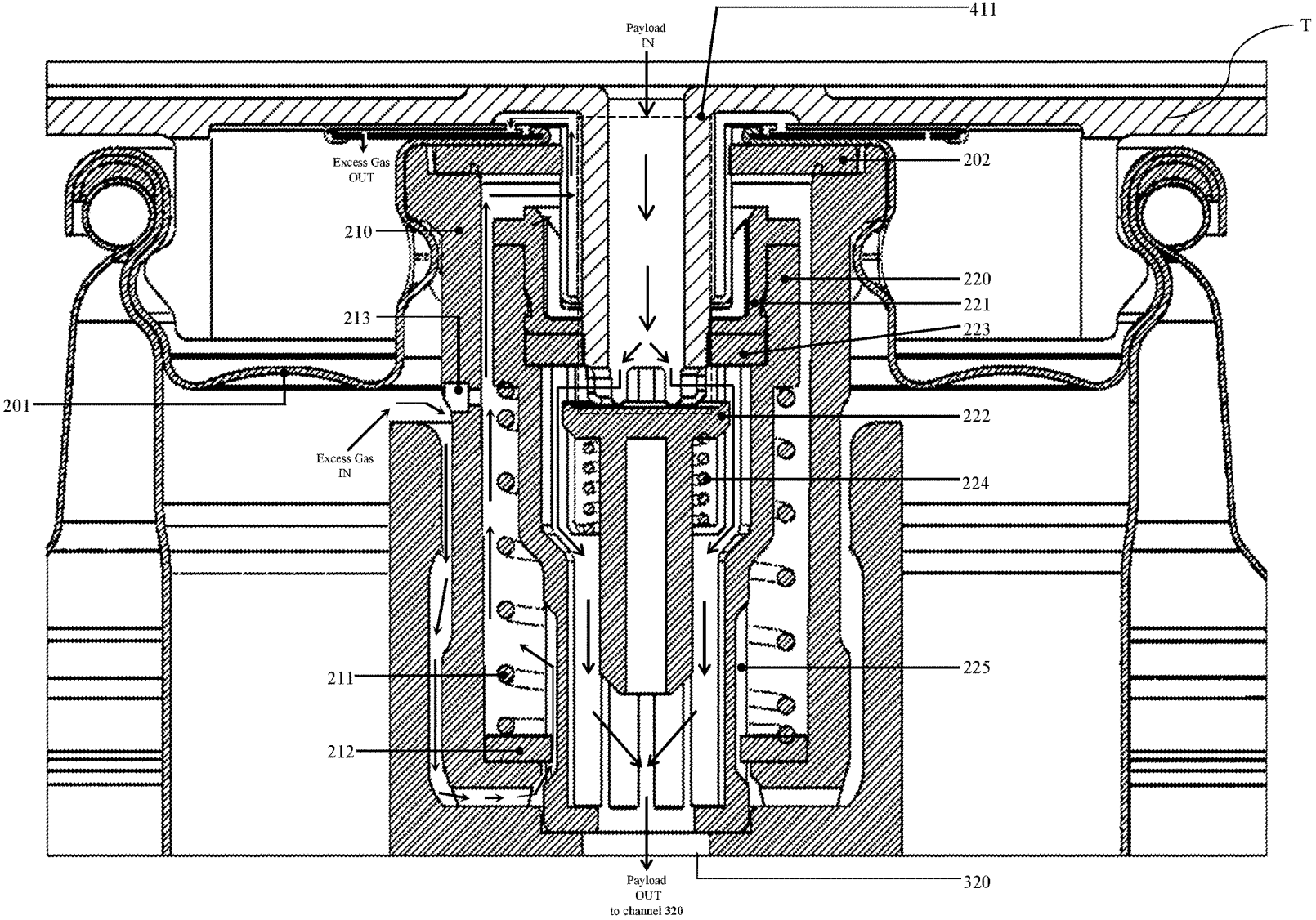
FIG. 4 is a zoomed-in diagram of FIG. 3 focusing on the aerosol valve assembly on the aerosol container for illustrating the content-filling path and the gas-discharge path.

With reference to FIG. 3 and FIG. 4, the content-filling mechanism (I) and gas-discharging mechanism (II) involving the aerosol valve assembly 200 and a content-filling-and-gas-discharging device 410 shall now be described in detail. FIG. 3 illustrates a cross-sectional view of the aerosol container and the aerosol valve assembly 200, activated by the attached with content-filling-and-gas-discharging device 410. FIG. 4 illustrates a zoomed-in view of FIG. 3 that shows the flow of external content, preferably a payload being a hardener component, entering the aerosol container and excess gas exiting the aerosol container when said device 410 activates the aerosol valve assembly 200. While the content-filling mechanism (I) and gas-discharging mechanism (II) that are to be described to operate simultaneously, it is not limited to such an embodiment. In an alternative embodiment, the content-filling mechanism (I) and gas-discharging mechanism (II) may operate independently from each other through the use of a content-filling device or a gas-discharging device separately.

Referring to FIG. 3, the content-filling-and-gas-discharging device 410, having a content-filling-and-discharge activation stem 411, is shown. This device 410 allows for the simultaneous operation of the content-filling mechanism (I) and gas-discharging mechanism (II). Preferably, the content-filling-and-gas-discharging device 410 is part of a filling tank T. The aerosol container may be in the aerosol container manufacturing line where a component (such as the hardener component) is to be filled into the inner chamber 120*a*. Preferably, before activation, the content-filling-and-discharge activation stem 411 is to be directly positioned to be above the aperture 201*a* of the mounting cup 201 of the aerosol valve assembly 200 that leads to the valve housing 210 within the aerosol container.

Referring to FIG. 3, the aerosol valve assembly 200 is activated when the aperture 201*a* of the mounting cup 201 is penetrated by the activation stem 411 of the content-filling-and-gas-discharging device 410. This allows content-filling mechanism (I) and gas-discharging mechanism (II) to operate. Preferably, the activation stem 411 is tapered, or extends telescopically, for its body has varying diameters to allow it to vertically displace both the valve core 220 and the valve shaft 222 in the valve core 220.

Referring to FIG. 4, the thinner portion of the activation stem 411 vertically displaces the valve shaft 222 of the valve core 220, forming a gap between the valve shaft 222 and the second gasket seal 223. With this, the content-filling-and-gas-discharging device 410 provides an inflow of external content, preferably a payload being a hardener component, into the aerosol container as per the content-filling mechanism (I).

Referring to FIG. 4 as well, the thicker portion of the activation stem 411 vertically displaces the valve core 220 itself until its bottom end portion slightly extrudes outwardly from the valve housing 210, leaving behind a gap between the first gasket seal 202 and the upper-end portion of the cap portion 221 of the valve core 220. The length of the activation stem 411 configured so that it does not vertically displace the valve core 220 until it displaces the puncture member 300 to cause the divider 121 to rupture. Moreover, as the activation stem 411 vertically displaced the valve core 220, its indented portions 225 slightly protrudes out from the valve housing. With this, the content-filling-and-gas-discharging device 410 provides degassing of the aerosol container as per the gas-discharging mechanism (II).

FIG. 4 further illustrated the flow passages that are formed. In particular, there are two flow passages shown in FIG. 4: a content-filling passage (the path shown in the "→" arrows) and a gas-discharge passage (the path shown in the "➔" arrows). The components involved in the content-filling passage forms the content-filling mechanism (I), while the components involved in the gas-discharge passage form the gas-discharging mechanism (II).

Regarding the content-filling passage shown in FIG. 4, it is the passage where the external content from the tank L undertakes to fill the inner chamber 120*a*. The path of the content-filling passage begins at the gap is formed between the valve shaft 222 and the second gasket seal 223. Next, the external content flows through the internal walls of the valve core 220 (since the valve core 220 is hollow) and reaches the bottom end portion of the valve core 220. Finally, the external content flows through the channel 320 of the puncture member 300 so that it fills the vicinity of the inner chamber 120*a*. With this, the description of the content-filling mechanism (I) is complete.

Regarding the gas-discharge passage shown in FIG. 4, it is the passage where excess gas, which may be present in the inner chamber 120*a*, exits the aerosol container. This creates a pseudo-vacuum environment within the inner chamber 120*a* with little to no gas that may cause oxidation of the external content filled in the inner chamber 120*a*. The path of the gas-discharge passage begins at gap formations between the mounting cup 201 and the puncture member 300 whereby the excess gas enters therein. Next, the excess gas travels through the walls of the recess 310 of the puncture member 300 and the external walls of the valve housing 210. Following this, the excess gas enters the valve housing 210 through the indented portions 225 of the valve core (since the indented portions 225 have protruded out as well). After this, the excess gas travels within the valve housing 210 of the aerosol container, through the internal walls of the valve housing 210 and the external walls of the valve core 220. Also, the presence of the side hole 213 may serve to further enhance gas-discharging mechanism (II) by allowing the discharge of the excess gas through the provision of a direct path for the excess gas to enter the valve housing 210. Then, the excess gas travels upwards until it reaches the gap between the first gasket seal 202 and the upper-end portion of the cap portion 221 of the valve core 220. Once the excess gas reaches this area, it exits the aerosol container through a discharge conduit 412 incorporated with the activation stem 411. Finally, this discharge conduit 412 leads the excess gas out into the environment where it shall be discharged. With this, the description of the gas-discharging mechanism (II) is complete.

Figure 5:
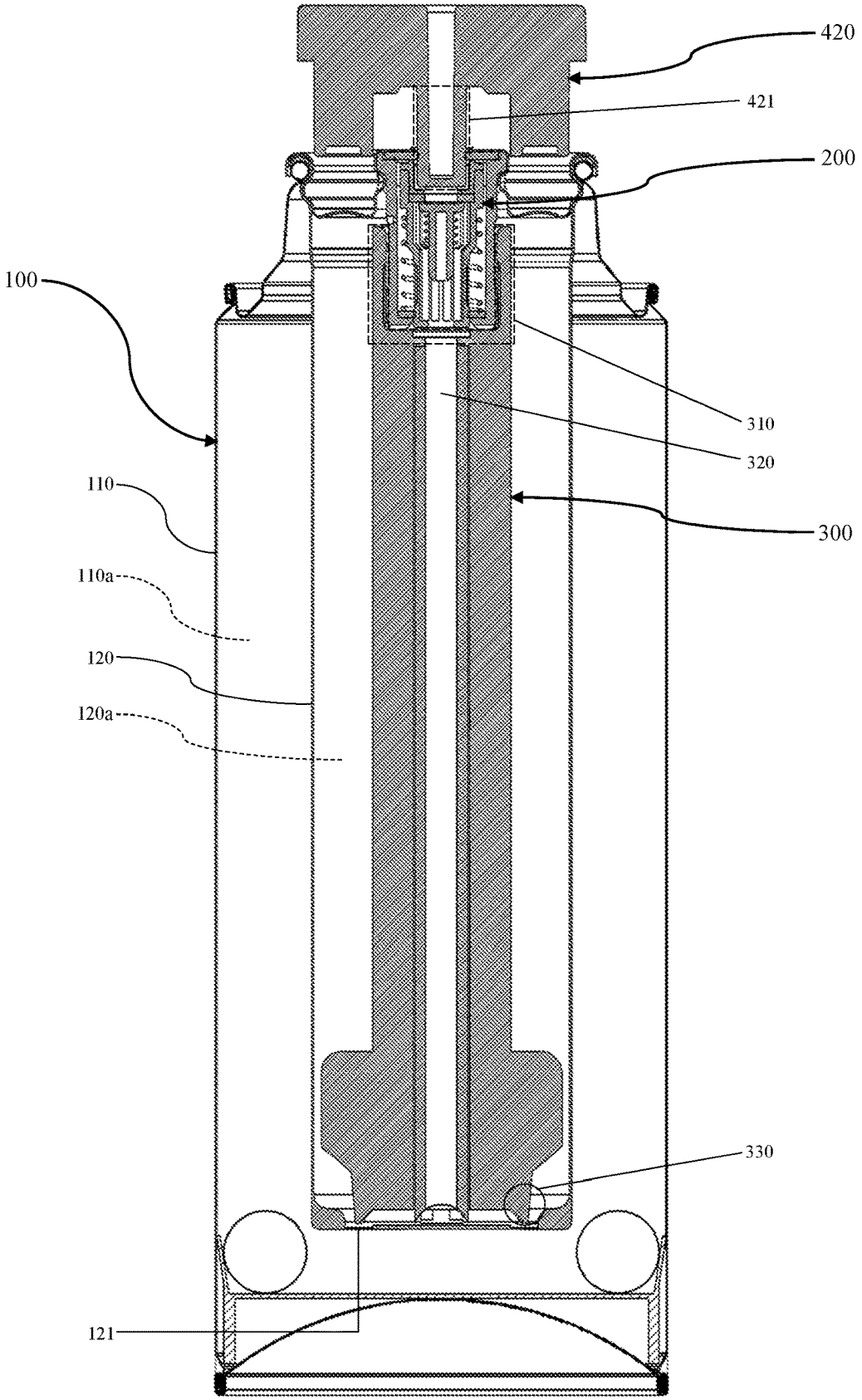
FIG. 5 is a diagram illustrating the cross-sectional view of the aerosol container and the aerosol valve assembly in a non-activated state, with the rupturing mechanism yet to be operated.
Figure 6:
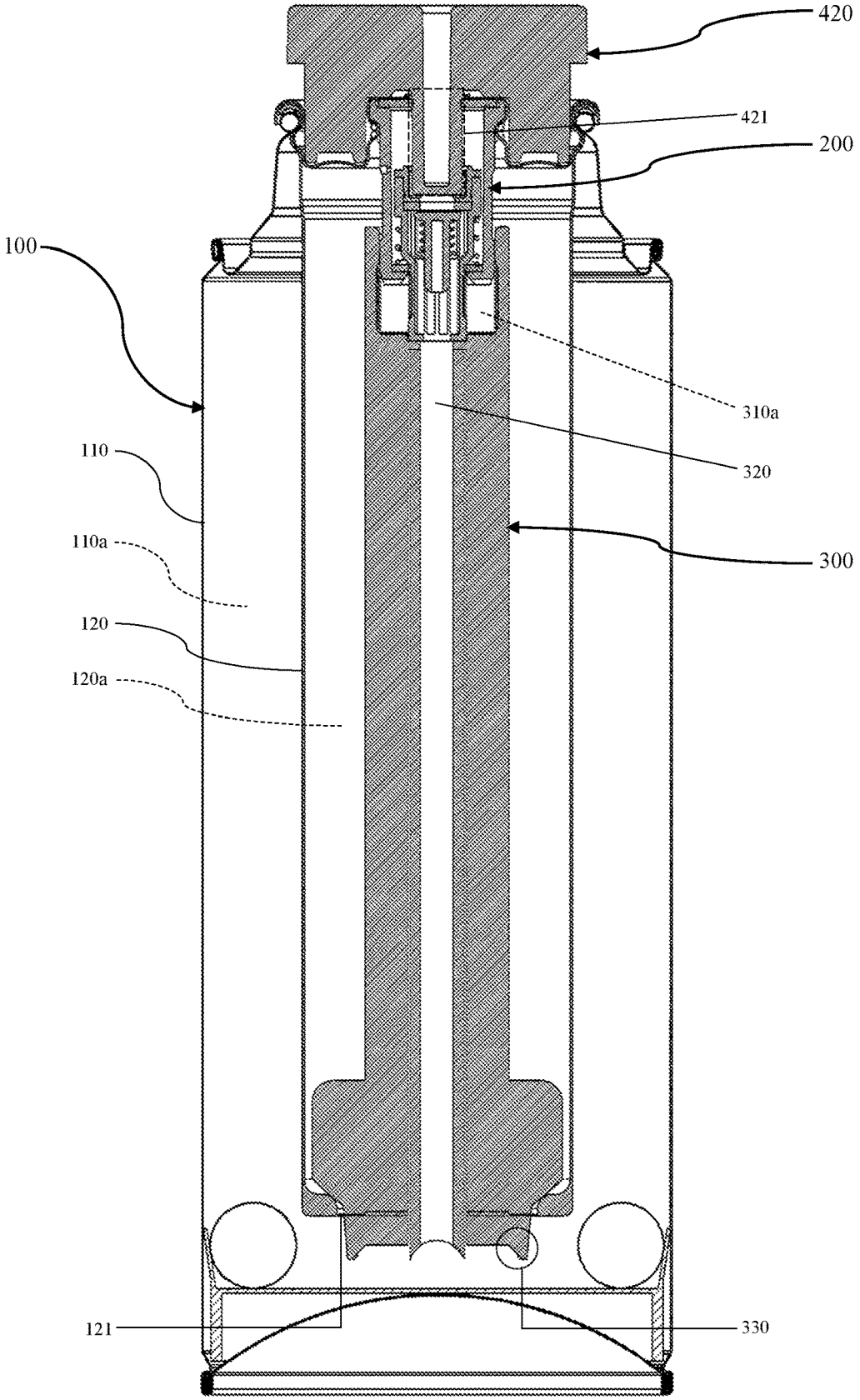
FIG. 6 is a diagram illustrating the cross-sectional view of the aerosol container and the aerosol valve assembly in an activated state that allows operation of the rupturing mechanism.
Figure 7:
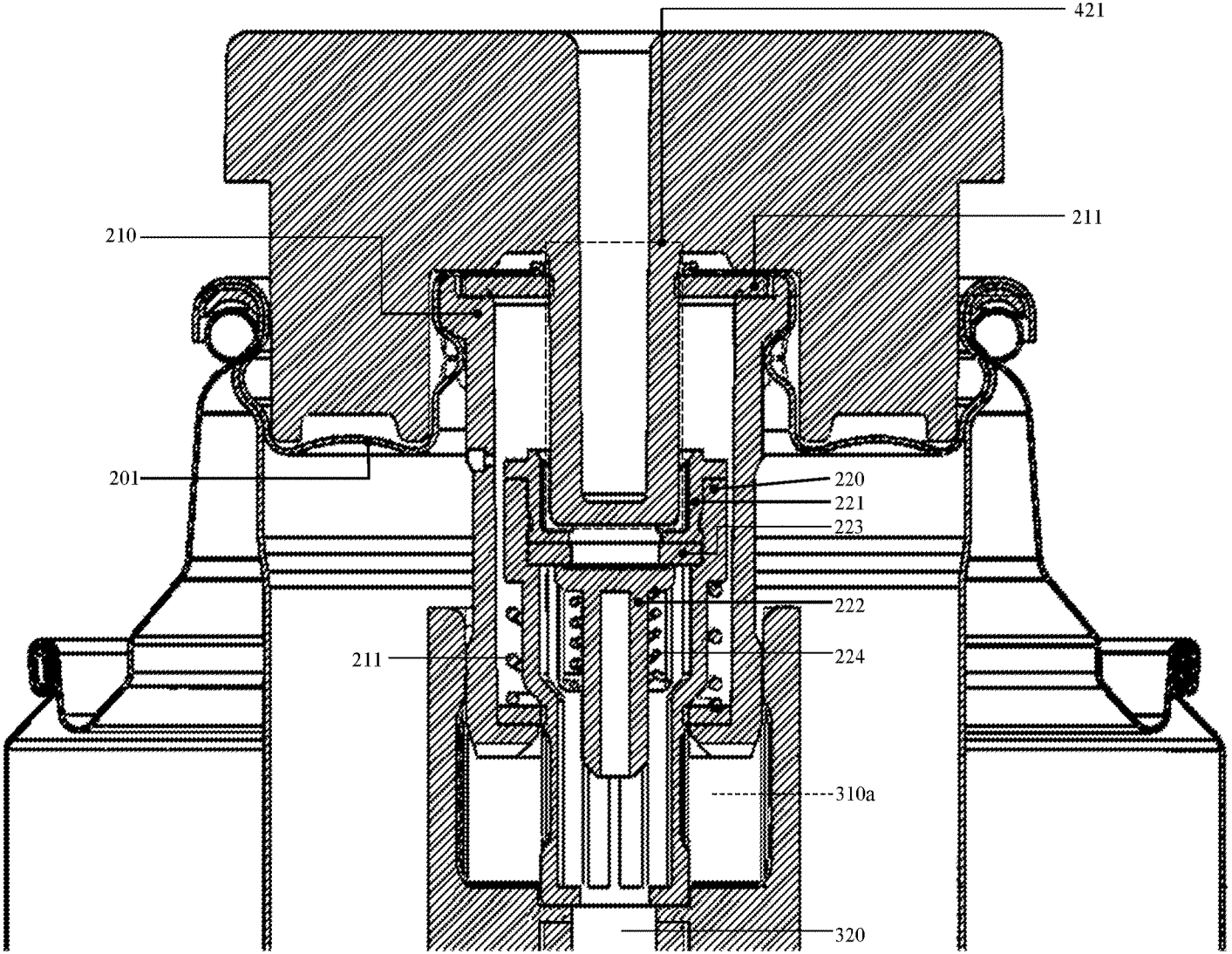
FIG. 7 is a zoomed-in diagram of FIG. 6 focusing on the aerosol valve assembly on the aerosol container for illustrating the positions of the components after the rupturing mechanism is activated.

With reference to FIG. 5 to FIG. 7, the rupturing mechanism (III) involving the aerosol valve assembly 200 and a rupturing device 420 shall now be described. FIG. 5 illustrates a cross-sectional view of the aerosol container and the aerosol valve assembly 200 in a non-activated state, but ready to be attached with the rupturing device 420. FIG. 6 illustrates a cross-sectional view of the aerosol container and the aerosol valve assembly 200 in an activated state, attached with the rupturing device 420. FIG. 7 illustrates a zoomed-in view of FIG. 6 that shows positions of the components of the aerosol valve assembly 200 when in the said activated state.

Referring to FIG. 5, the rupturing device 420, having a rupture activation stem 421, is shown. This device 420 allows for the operation of rupturing mechanism (III). Preferably, before activation as shown in FIG. 5, the rupture activation stem 421 is directly positioned to be above the aperture 201*a* of the mounting cup 201 of the aerosol valve assembly 200 that leads to the valve housing 210 within the aerosol container. Referring to FIG. 6, the aerosol valve assembly 200 is activated when the aperture 201*a* of the mounting cup 201 is penetrated by the activation stem 421 of the rupturing device 420. This allows rupturing mechanism (III) to operate. Preferably, the activation stem 421 is not tapered and having a constant diameter. The diameter of the activation stem 421 is large enough such that it at least slightly encompasses the annular base of the cap portion 221 of the valve core 220. This shall allow the activation stem 421 to only vertically displace the valve core 220.

Referring to FIG. 7, the rupture activation stem 421 shall force the entirety of the valve core 220 to displace downwards. The length of the activation stem 421 is long enough to enable the valve core 220 to protrude out from the valve housing 210 and provide a vertical displacement to the puncture member 300 (since the aerosol valve assembly 200 rests within the recess 310). This causes the projections 330 to rupture the divider 121 of the inner compartment 120 so that content of the inner chamber 120*a* coalesces, or mixes, with content of the outer chamber 110*a*. In particular, the hardener component in the inner chamber 120*a*, and the resin component and propellant in the outer chamber 110*a*, coalesce or mix. This forms a coalesced content. When the puncture member 300 punctures the divider 121, the dip tube 321 reaches the base of the outer compartment 110. With this, the description of the puncture mechanism (III) is complete.

As the rupturing device 420 is taken off from the aerosol container (not shown), the valve core 210 retracts back into its valve housing due to the first resilient member 211 and re-assumes a position similar to FIG. 2. However, there will be a permanent positional change for the puncture member 300 within the aerosol container. Unlike FIG. 2, the valve housing 210 of the aerosol container will not be rested on the recess 310 of the puncture member 300 anymore. As the puncture member 300 has been displaced downwardly in a permanent manner, the recess 310 forms a cavity 310*a*.

Figure 8:
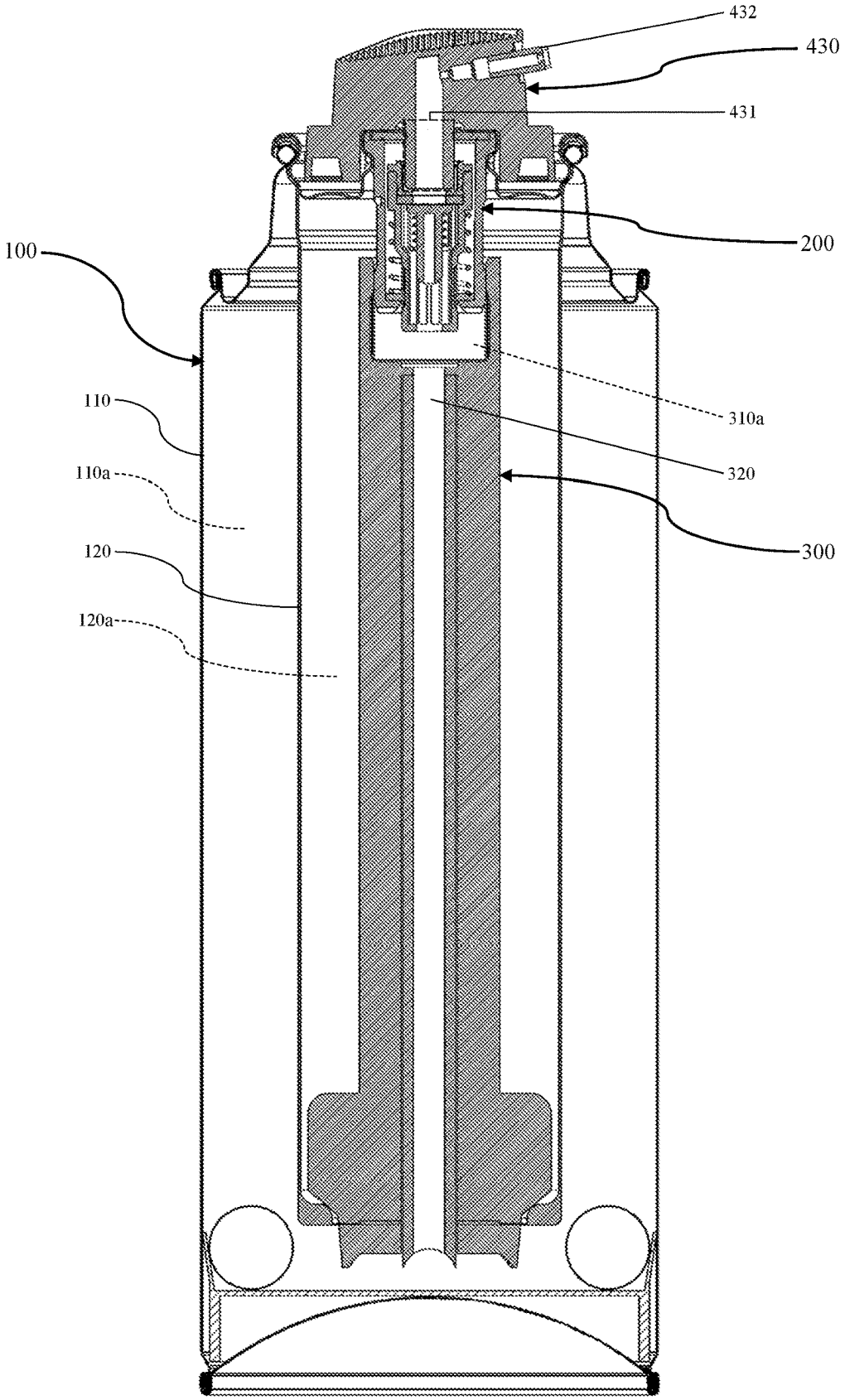
FIG. 8 is a diagram illustrating the cross-sectional view of the aerosol container and the aerosol valve assembly in an activated state that allows operation of the content-dispensing mechanism.
Figure 9:
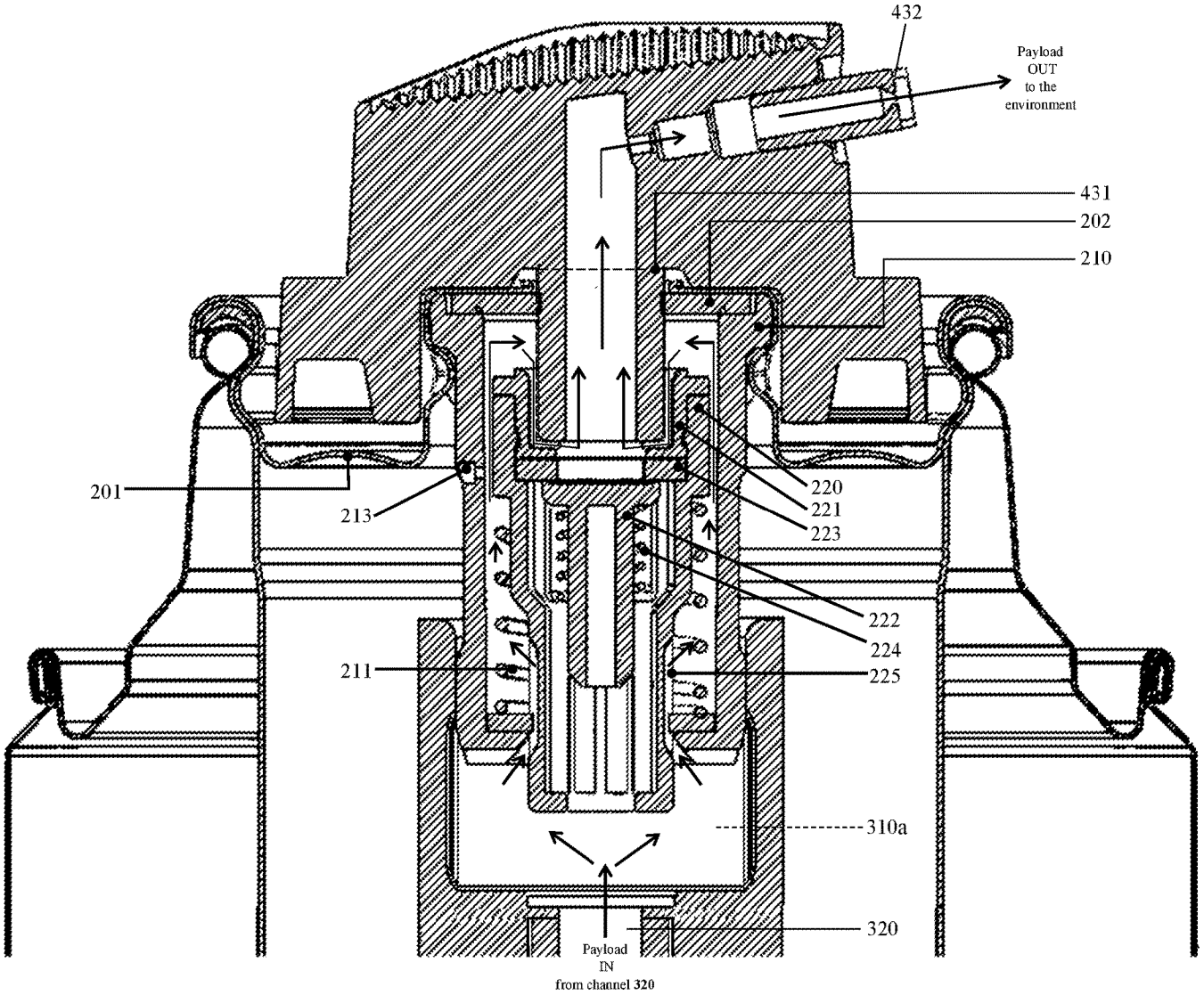
FIG. 9 is a zoomed-in diagram of FIG. 8 focusing on the aerosol valve assembly on the aerosol container for illustrating the content-dispensing path.

With reference to FIG. 8 and FIG. 9, the content-dispensing mechanism (IV) involving the aerosol valve assembly 200 and a content-dispensing device 430 shall now be described. FIG. 8 illustrates a cross-sectional view of the aerosol container and the aerosol valve assembly 200 in an activated state, attached with content-dispensing device 430. FIG. 9 illustrates a zoomed-in view of FIG. 8 that shows the flow of content exiting the aerosol container when the said device 430 is in the activated state.

Referring to FIG. 8, the content-dispensing device 430, having a content-dispensing activation stem 431, is shown. This device 430 allows for the operation of the content-dispensing mechanism (IV). Preferably, the content-dispensing device 430 is similar to a conventional aerosol container spray head, including having a nozzle 432 and conduits leading to it. Preferably, before activation, the activation stem 431 is to be directly positioned to be above the aperture 201*a* of the mounting cup 201 of the aerosol valve assembly 200 that leads to the valve housing 210 within the aerosol container.

Referring to FIG. 9, the aerosol valve assembly 200 is activated when the aperture 201*a* of the mounting cup 201 is penetrated by the activation stem 431 of the content-dispensing device 430. This allows content-dispensing mechanism (IV) to operate. Preferably, the activation stem 431 is not tapered and having a constant diameter. The diameter of the activation stem 431 is large enough such that it at least slightly encompasses the annular base of the cap portion 221 of the valve core 220. This allows the activation stem 431 to only vertically displace the valve core 220.

Referring to FIG. 9 as well, the content-dispensing activation stem 431 in particular vertically displaces the valve core 220 itself until its bottom end portion extrudes outwardly from the valve housing 210 with the indented portions 225 of the valve core 220 is exposed as well. The activation stem 431 also leaves behind a gap between the first gasket seal 202 and the upper-end portion of the cap portion 221 of the valve core 220. With this, the content-dispensing device 430 provides degassing of the aerosol container as per the content-dispensing mechanism (IV).

FIG. 9 further illustrates flow passages that are formed. In particular, there is one flow passage shown in FIG. 9, which is a content-dispensing passage (the path shown in the "→" arrows). The components involved in the content-dispensing passage forms the content-dispensing mechanism (IV).

Regarding the content-dispensing passage shown in FIG. 9, it is the passage where the coalesced content within the aerosol container undertakes to be dispensed out into the environment through the nozzle 432. In the activated state as per FIG. 8, a differential pressure is created between the environment and the pressurized interior of the aerosol container due to the presence of the propellant. As such, the path of the content-dispensing passage begins at the bottom end portion of the dip tube 321 that is now located at the base of the inner compartment 120 where the coalesced content is drawn thereto. Next, the coalesced content travels upwards along the channel 320 of the dip tube 321 to reach the cavity 310*a*. Following this, the coalesced content enters the valve housing 210 through the indented portions 225 of the valve core 220. Then, the coalesced content travels through the internal walls of the valve housing 210 and the external walls of the valve core 220. While it does so, propellant may enter into the valve housing through the side hole 213 to be further mixed, or undergo secondary mixing, with the coalesced content.

Once the coalesced content reaches the gap formed between the first gasket seal 202 and the upper-end portion of the cap portion 221 of the valve core 220, the coalesced content then squeezes through conduits formed between the external walls of the content-dispensing activation stem 431 and the walls of the cap portion 221 to reach an inlet of the activation stem 431. Finally, the coalesced content goes through the conduit of the content-dispensing device 430 to reach the nozzle 432 for it to be dispensed out into the environment. The further mixing, or secondary mixing between the coalesced content and the propellant hat had entered through the side hole 213 may provide a uniform dispensation of the coalesced content for a better spray effect. With this, the description of the content-dispensing mechanism (IV) is complete.

The aerosol valve assembly 200 of the aerosol container of the present invention may allow the aerosol container to be refilled in the future after its content have been used up. However, by the time the rupturing mechanism (III) is actuated, the positional configuration of components within the aerosol container undergoes an irreversible change, and as such the aerosol container may only be refilled with content such as a payload being single-component paint.

Ultimately, the present invention has provided an aerosol container, which is compatible to have multi-component payload, being able to support filling of content, degassing of air from the aerosol container, coalescing of content and dispensing of content using the same aerosol valve assembly 200. Said aerosol valve assembly provides means to activate a content-filling mechanism, a gas-discharging mechanism, a rupturing mechanism, a content-dispensing mechanism, or any combination thereof.

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

The invention claimed is:

1. An aerosol container, comprising:

a body including an outer chamber and an inner chamber positioned within the outer chamber, the inner chamber having a divider that separates it from the outer chamber, and the inner chamber further formed with an opening;

a puncture member for rupturing the divider; and an aerosol valve assembly enclosing the opening of the inner chamber at least having both a content-filling mechanism and a gas-discharging mechanism, and, optionally, any one of, or a combination of, a rupturing mechanism and a content-dispensing mechanism;

wherein, upon activation of the aerosol valve assembly, the content-filling mechanism enables formation of a content-filling passage to allow external content to be added into the body;

wherein the gas-discharging mechanism enables formation of a gas-discharging passage to allow unwanted or excess gas to be released out of the body when the external content is added into the body;

wherein the rupturing mechanism acts on the puncture member to rupture the divider so as to allow coalescing of content within the inner chamber and the outer chamber to form a coalesced content;

wherein the content-dispensing mechanism enables formation of a content-dispensing passage to dispense the content out of the body;

a mounting cup mounted to the opening of the inner chamber and having an aperture;

a valve housing positioned within the inner chamber and adjacent to the aperture of the mounting cup;

a valve core accommodated within the valve housing, having a cap portion, a valve shaft, and an inlet formed between the cap portion and the valve shaft where the valve shaft is movable within the valve core to expose or close the inlet;

at least one detachable component inserted into the aperture of the mounting cup, being either:

a content-filling device having a content-filling stem;

a gas-discharging device having a discharge activation stem;

a content-filling and gas-discharging device having a content-filling and a discharge activation stem;

a rupturing device having a rupture activation stem; and optionally, a content-dispensing device having a content-dispensing activation stem;

wherein the content-filling mechanism and gas-discharging mechanism are configured to operate simultaneously upon activation of the aerosol valve assembly by the content-filling and discharge activation stem which allows the external content to be supplied from the discharge activation stem through the cap portion while moving the valve shaft to expose the inlet of the valve core for directing the external content into the valve core, and moving the valve core away from the aperture of the mounting cup to create a gap therebetween to allow exit of the unwanted or excess gas from the aerosol container through the content-filling and gas-discharging device.

2. The aerosol container according to claim 1, wherein the content-filling mechanism includes the valve shaft, and the valve core with the cap portion being configured to receive the content-filling stem therethrough for supplying the external content into the valve core while pushing the valve shaft to expose the inlet of the valve core for directing the external content through the valve core and into the inner chamber.

3. The aerosol container according to claim 2, wherein the content-filling passage includes the content-filling device, the valve core, a channel formed by a dip tube within the puncture member that is connected to the valve core, and the inner chamber.

4. The aerosol container according to claim 1, wherein the gas-discharging mechanism includes the valve shaft, and the valve core with the cap portion configured to receive the discharge activation stem for moving the valve core away from the aperture of the mounting cup to create a gap therebetween to allow exit of the unwanted or excess gas from the body of the aerosol container through the gas-discharging device.

5. The aerosol container according to claim 4, wherein the gas-discharging passage includes, any one of, or a combination of, the inner chamber, the valve housing and a discharge conduit within the gas-discharging device, and a combination of the inner chamber, a passageway formed between the puncture member and the valve housing, valve core, and the discharge conduit of the gas-discharging device.

6. The aerosol container according to claim 1, wherein the rupturing mechanism includes the valve core, and the valve housing which sits within a recess formed at one end of the puncture member that is slidable along the valve housing such that upon activation of the valve assembly by the rupturing activation stem, the valve core is pushed to displace the puncture member towards the direction of the divider to rupture it.

7. The aerosol container according to claim 6, further comprising a dip tube forming a channel inside the puncture member that moves along with the puncture member to reach the outer chamber upon rupturing the divider.

8. The aerosol container according to claim 7, wherein the valve core is configured to substantially or fully return to its original position within the valve housing upon removal of the rupture activation stem, that disconnects the valve core and the channel of the puncture member, forming a cavity within the puncture member by having the recess covered by the valve housing.

9. The aerosol container according to claim 1, wherein the content-dispensing mechanism includes the valve housing, and the valve core with the cap portion being configured to receive the content-dispensing activation stem that displaces the valve core away from the aperture of the mounting cup, leaving a gap therebetween to allow content to be dispensed out of the aerosol container through the content-dispensing device.

10. The aerosol container according to claim 9, wherein the puncture member is formed with a recess at one end that is covered by the valve housing to create a cavity within the puncture member, and has a dip tube forming a channel inside the puncture member.

11. The aerosol container according to claim 10, wherein the content-dispensing passage includes the body of the aerosol container, the channel within the puncture member, the cavity of the puncture member, the valve housing, conduits between the cap portion of the valve core and the content-dispensing activation stem, and the content-dispensing device.

12. The aerosol container according to claim 11, wherein the content-dispensing activation stem is formed with a dimension to fix position of the valve core during formation of the gap.

13. An aerosol valve assembly for a body of an aerosol container, comprising:

a content-filling mechanism, a gas-discharging mechanism, a rupturing mechanism, and, optionally, a content-dispensing mechanism;

wherein, upon activation of the aerosol valve assembly, the content-filling mechanism enables formation of a content-filling passage to allow external content to be added into the body of the aerosol container;

wherein the gas-discharging mechanism enables formation of a gas-discharging passage to allow unwanted or excess gas to be released out of the body of the aerosol container when the external content is added into the body;

wherein the rupturing mechanism enables rupturing of a divider to allow coalescing of content within the body of the aerosol container to form a coalesced content; and wherein the content-dispensing mechanism enables formation of a content-dispensing passage to dispense the content out of the body of the aerosol container;

a mounting cup mounted to the opening of the inner chamber and having an aperture;

a valve housing positioned within the inner chamber and adjacent to the aperture of the mounting cup;

a valve core accommodated within the valve housing, having a cap portion, a valve shaft, and an inlet formed between the cap portion and the valve shaft where the valve shaft is movable within the valve core to expose or close the inlet;

at least one detachable component inserted into the aperture of the mounting cup, being either:

a content-filling device having a content-filling stem;

a gas-discharging device having a discharge activation stem;

a content-filling and gas-discharging device having a content-filling and a discharge activation stem;

a rupturing device having a rupture activation stem; and optionally, a content-dispensing device having a content-dispensing activation stem;

wherein the content-filling mechanism and gas-discharging mechanism are configured to operate simultaneously upon activation of the aerosol valve assembly by the content-filling and discharge activation stem which allows the external content to be supplied from the discharge activation stem through the cap portion while moving the valve shaft to expose the inlet of the valve core for directing the external content into the valve core, and moving the valve core away from the aperture of the mounting cup to create a gap therebetween to allow exit of the unwanted or excess gas from the aerosol container through the content-filling and gas-discharging device.

14. An aerosol container, comprising:

a body including an outer chamber and an inner chamber positioned within the outer chamber, the inner chamber having a divider that separates it from the outer chamber, and the inner chamber further formed with an opening;

a puncture member for rupturing the divider; and an aerosol valve assembly enclosing the opening of the inner chamber at least having both a content-filling mechanism and a gas-discharging mechanism, and, optionally, any one of, or a combination of, a rupturing mechanism and a content-dispensing mechanism;

wherein, upon activation of the aerosol valve assembly, the content-filling mechanism enables formation of a content-filling passage to allow external content to be added into the body;

wherein the gas-discharging mechanism enables formation of a gas-discharging passage to allow unwanted or excess gas to be released out of the body when the external content is added into the body;

wherein the rupturing mechanism acts on the puncture member to rupture the divider so as to allow coalescing of content within the inner chamber and the outer chamber to form a coalesced content; and wherein the content-dispensing mechanism enables formation of a content-dispensing passage to dispense the content out of the body;

a mounting cup mounted to the opening of the inner chamber and having an aperture;

a valve housing positioned within the inner chamber and adjacent to the aperture of the mounting cup;

a valve core accommodated within the valve housing, having a cap portion, a valve shaft, and an inlet formed between the cap portion and the valve shaft where the valve shaft is movable within the valve core to expose or close the inlet;

at least one detachable component inserted into the aperture of the mounting cup, being either:

a content-filling device having a content-filling stem;

a gas-discharging device having a discharge activation stem;

a content-filling and gas-discharging device having a content-filling and a discharge activation stem;

a rupturing device having a rupture activation stem; and optionally, a content-dispensing device having a content-dispensing activation stem;

wherein the content-dispensing mechanism includes the valve housing, and the valve core with the cap portion being configured to receive the content-dispensing activation stem that displaces the valve core away from the aperture of the mounting cup, leaving a gap therebetween to allow content to be dispensed out of the aerosol container through the content-dispensing device.

* * * * *